US007841477B2

(12) United States Patent
Hansen

(10) Patent No.: US 7,841,477 B2
(45) Date of Patent: Nov. 30, 2010

(54) CYCLONE SEPARATOR

(75) Inventor: Morten Kaare Hansen, Taastrup (DK)

(73) Assignee: Flsmidth A/S, Valby (DK)

( * ) Notice: Subject to any disclaimer, the term of this patent is extended or adjusted under 35 U.S.C. 154(b) by 181 days.

(21) Appl. No.: 12/279,395

(22) PCT Filed: Dec. 28, 2006

(86) PCT No.: PCT/IB2006/055047

§ 371 (c)(1),
(2), (4) Date: Aug. 14, 2008

(87) PCT Pub. No.: WO2007/110715

PCT Pub. Date: Oct. 4, 2007

(65) Prior Publication Data

US 2009/0057209 A1 Mar. 5, 2009

(30) Foreign Application Priority Data

Mar. 24, 2006 (DK) ..... 2006 00416

(51) Int. Cl.
*B04C 5/12* (2006.01)
*B04C 5/13* (2006.01)

(52) U.S. Cl. ..... 209/721; 209/732; 208/161

(58) Field of Classification Search ..... 209/721, 209/732; 208/161
See application file for complete search history.

(56) References Cited

U.S. PATENT DOCUMENTS 3,693,791 A * 9/1972 Beck ..... 209/710
5,207,805 A * 5/1993 Kalen et al. ..... 95/271

(Continued)

FOREIGN PATENT DOCUMENTS

DE 4135171 A1 4/1993

(Continued)

*Primary Examiner*—Gene Crawford
*Assistant Examiner*—Terrell H Matthews
(74) *Attorney, Agent, or Firm*—Jeffrey S. Melcher; Manelli Denison & Selter PLLC

(57) ABSTRACT

Described is a cyclone separator comprising a cyclone housing (1), a discharge duct (5) and a central tube (3) for diverting gases, said central tube (3) extends axially into the cyclone housing (1) and being composed by a number of segments (3*a*) which are suspended on a supporting element (15) provided in the area between the cyclone housing (1) and the discharge duct (5). The cyclone separator is peculiar in that it comprises a number of carrying means (17) which are evenly distributed and fixed to the inner side of the cyclone housing (1) and/or the discharge duct (5), and in that the supporting element (15) comprises an annular disc which is loosely fitted on top of the carrying means (17) and having an outer diameter which is smaller than the inner diameter of the cyclone housing (1) and/or the discharge duct (5) so that a clearance (18) is provided between the annular disc (15) and the cyclone housing (1) and/or the discharge duct (5). Hereby is obtained a significant reduction in the heat transmission from the supporting element to the cyclone housing and/or the discharge duct so that the radial temperature gradient in the supporting element is reduced with an approximately uniform temperature over the radial cross section of the element. Hence the thermal stresses in the supporting element will be substantially reduced. This is mainly ascribable to the reduction in the contact area between the supporting element and the cyclone housing and/or the discharge duct.

11 Claims, 1 Drawing Sheet

U.S. PATENT DOCUMENTS

Figure 1:
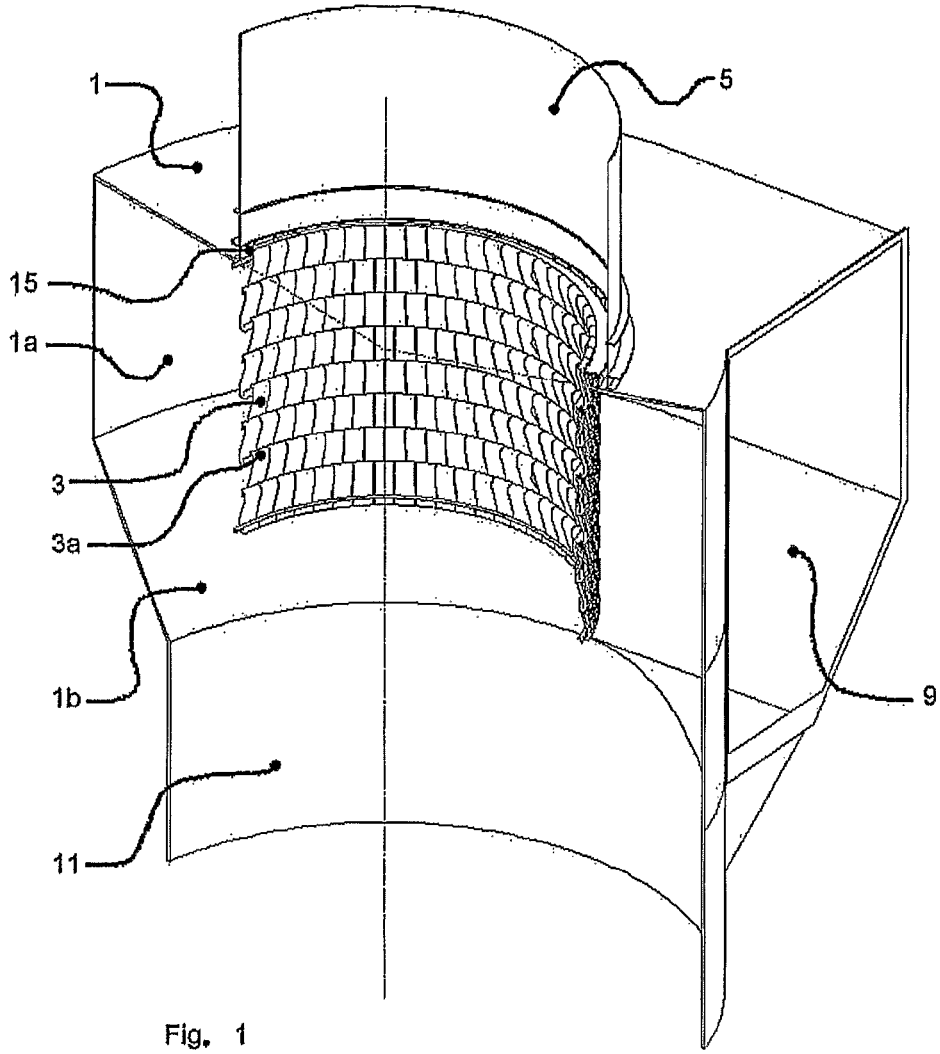

| | | | | |
|---|---|---|---|---|
| 5,362,379 | A * | 11/1994 | Helstrom | 208/161 |
| 6,036,028 | A * | 3/2000 | Jungmann et al. | 209/732 |
| 6,428,591 | B1 * | 8/2002 | Bouchillon et al. | 55/459.1 |
| 2001/0052223 | A1 * | 12/2001 | Filges et al. | 55/434.1 |

FOREIGN PATENT DOCUMENTS

| | | | |
|---|---|---|---|
| WO | 9638231 | A1 | 12/1996 |

* cited by examiner

CYCLONE SEPARATOR

This application is a national stage entry filed under 35 U.S.C. 371 of PCT/IB2006/055047, filed 28 Dec. 2006. This application also claims foreign priority to Denmark Patent App'n Ser. No. PA200600416, filed 24 Mar. 2006.

The present invention relates to a cyclone separator comprising a cyclone housing, a discharge duct and a central tube for diverting gases, said central tube extends axially into the cyclone housing and being composed by a number of segments which are suspended on a supporting element provided in the area between the cyclone housing and the discharge duct.

Cyclone separators are generally known and widely used for many different technical applications in which two phases such as gases and material particles in suspension are to be separated. Cyclones typically comprise a cyclone housing with an upper substantially cylindrical part and a lower conical part, an often tangential inlet in the upper part of the cyclone housing for introducing the suspension which is to be separated, an outlet at the bottom of the conical part for diverting one fraction of the suspension, as well as a central tube extending with a free end axially into the cyclone housing for diverting the second fraction of the suspension via a discharge duct.

From U.S. Pat. No. 4,505,051 is known an example of a cyclone separator of the aforementioned kind. In this known cyclone separator the upper row of the segments of the central tube comprises an L-shaped part which protrudes outwards and downwards and which rests against a supporting element which is formed with an upwardly projecting part and which is rigidly connected by welding to the cyclone housing/discharge duct. In instances where the cyclone separator is used to separate hot material/gas suspensions, for example in connection with the heating of cement raw materials for cement manufacture, where the temperature may reach a level as high as 900° C., the heat impact on the central tube will be quite significant, leading to changes in the transverse dimensions. It is a particular feature of the known cyclone separator according to U.S. Pat. No. 4,505,051 that, in order to prevent serious damage to the central tube, the special suspension of the segments of the central tube on the supporting elements takes due account of the fact that the central tube is affected by such changes of transverse dimensions because of the heat impact. For the known cyclone separator, the heat transmission from the central tube via the supporting element to the cyclone housing/discharge duct will, however, be quite significant due to the relatively large contact surfaces existing between these structural elements. As a consequence of this, a radial temperature gradient may occur in the supporting element ranging from a level around 600° C. at the innermost part of the element to around 200° C. at the outermost part of the element. A radial temperature gradient of this magnitude in the supporting element will give rise to significant thermal stress loads which under adverse circumstances may exceed the yield stress limit of the steel used, and involving, in worst-case scenario, a risk the central tube collapsing.

It is the object of the present invention to provide a cyclone separator by means of which the aforementioned disadvantage is significantly reduced.

This is obtained according to the invention by a cyclone separator of the kind mentioned in the introduction, and being characterized in that it comprises a number of carrying means which are evenly distributed and fixed to the inner side of the cyclone housing and/or the discharge duct, and in that the supporting element comprises an annular disc which is loosely fitted on top of the carrying means and having an outer diameter which is smaller than the inner diameter of the cyclone housing and/or the discharge duct so that a clearance is provided between the annular disc and the cyclone housing and/or the discharge duct.

Hereby is obtained a significant reduction in the heat transmission from the supporting element to the cyclone housing and/or the discharge duct so that the radial temperature gradient in the supporting element is reduced with an approximately uniform temperature over the radial cross section of the element. Hence the thermal stresses in the supporting element will be substantially reduced. This is mainly ascribable to the reduction in the contact area between the supporting element and the cyclone housing and/or the discharge duct.

The carrying means may be configured in any appropriate manner but for optimization of strength characteristics it is preferred that they are configured as shelf brackets having a substantially triangular shape.

The shelf brackets may be fixed to the cyclone housing and/or the discharge duct in any appropriate manner but it is preferred that they are fixed by welding.

The annular disc which forms the supporting element may be configured with an upwardly protruding flange in order to improve the fixation of the central tube segments which are typically formed with a corresponding downwardly protruding flange. In order to limit the thermal stresses in the upwardly protruding flange of the annular disc, the flange is preferentially divided into a number of segments.

The annular disc may also be provided with a heat-insulating layer on its upper side in order to reduce the heat transmission from the central tube.

It is preferred that the annular disc with its upwardly protruding flange and the shelf brackets are made of heat-resistant steel.

It is further preferred that the cyclone separator is lined in traditional manner.

Figure 2:
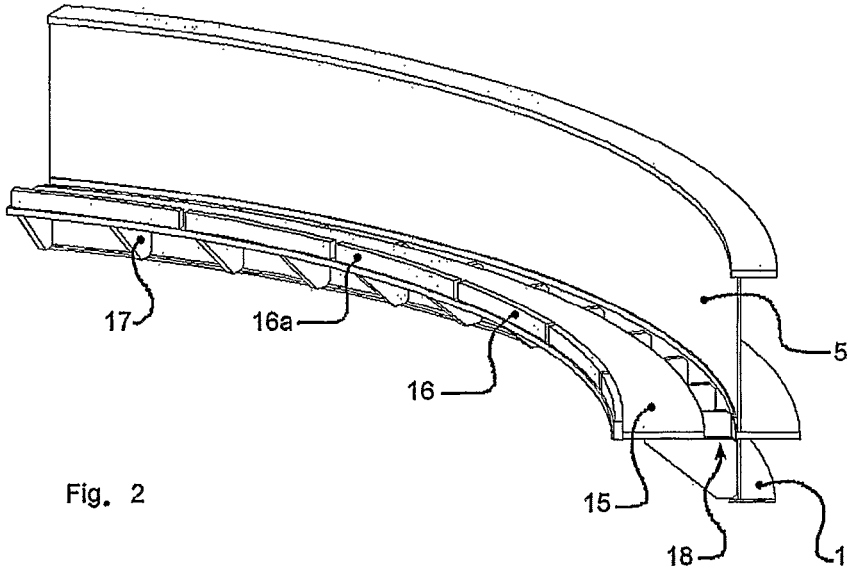

The invention will now be described in further details with reference to the drawing, where FIG. 1 shows a partial cut-through view of a cyclone separator comprising a central tube according to a preferred embodiment of the invention, and FIG. 2 shows details at the cyclone separator shown in FIG. 1.

In FIGS. 1 and 2 is seen a cyclone separator comprising a cyclone housing 1. The cyclone housing 1 has an upper cylindrical part 1*a* and a lower conical part 1*b*, a tangential inlet 9 for introducing the suspension to be separated, an outlet 11 at the bottom of the conical part for diverting one fraction of the suspension, as well as a central tube 3 which extends axially into the cyclone housing 1 for diverting the second fraction of the suspension via a discharge duct 5.

The central tube 3 is made up of a number of segments 3*a* which are suspended on a supporting element 15 at the upper end of the cyclone housing 1. The supporting element 15 comprises an upwardly protruding flange 16 which, as shown, is divided into segments 16*a*.

According to the invention the cyclone separator comprises a number of carrying means 17, here shown by way of shelf brackets 17 which are fixed, evenly distributed, to the lowermost part of the inner side of the discharge duct 5. The supporting element in the form of an annular disc 15 is loosely fitted on the shelf brackets 17, allowing the disc to move relative to the shelf brackets 17. The annular disc 15 is formed with an outer diameter which is smaller than the inner diameter of the discharge duct 5 thereby creating a clearance 18 between the annular disc 15 and discharge duct 5.

As mentioned in the introduction the heat transmission from the annular disc 15 via the shelf brackets 17 to the discharge duct 5 will thus be substantially reduced because of the reduction in the contact area so that the annular disc 15 has an approximately uniform temperature across its radial cross-section, hence being subjected to substantially reduced thermal stresses.

The invention claimed is:

1. A cyclone separator comprising:

a cyclone housing;

a discharge duct and a central tube for diverting gases, said central tube extends axially into the cyclone housing and being composed by a plurality of segments which are suspended on a supporting element provided in an area between the cyclone housing and the discharge duct; and a plurality of carrying means which are evenly distributed and fixed to the inner side of the cyclone housing and/or the discharge duct, and the supporting element comprises an annular disc which is movably fitted on top of the carrying means and having an outer diameter which is smaller than the inner diameter of the cyclone housing and/or the discharge duct so that a clearance is provided between the annular disc and the cyclone housing and/or the discharge duct.

2. Cyclone separator comprising:

a cyclone housing;

a discharge duct and a central tube for diverting gases, said central tube extends axially into the cyclone housing and being composed by a plurality of segments which are suspended on a supporting element provided in an area between the cyclone housing and the discharge duct; and a plurality of carrying means which are evenly distributed and fixed to the inner side of the cyclone housing and/or the discharge duct, and the supporting element comprises an annular disc which is movably fitted on to of the carrying means and having an outer diameter which is smaller than the inner diameter of the cyclone housing and/or the discharge duct so that a clearance is provided between the annular disc and the cyclone housing and/or the discharge duct, wherein the carrying means are configured as shelf brackets having a substantially triangular shape.

3. Cyclone separator according to claim 2, wherein the carrying means are fixed to the cyclone housing and/or the discharge duct by welding.

4. Cyclone separator according to claim 1, wherein the annular disc is configured with an upwardly protruding flange.

5. Cyclone separator according to claim 4, wherein the upwardly protruding flange of the annular disc is divided into a number of segments.

6. Cyclone separator according to claim 4, wherein the annular disc is provided with a heat-insulating layer on its upper side.

7. Cyclone separator comprising:

a cyclone housing;

a discharge duct and a central tube for diverting gases, said central tube extends axially into the cyclone housing and being composed by a plurality of segments which are suspended on a supporting element provided in an area between the cyclone housing and the discharge duct; and a plurality of carrying means which are evenly distributed and fixed to the inner side of the cyclone housing and/or the discharge duct, and the supporting element comprises an annular disc which is movably fitted on to of the carrying means and having an outer diameter which is smaller than the inner diameter of the cyclone housing and/or the discharge duct so that a clearance is provided between the annular disc and the cyclone housing and/or the discharge duct, wherein the carrying means are configured as shelf brackets, and the annular disc is configured with its an upwardly protruding flange, and the upwardly protruding flange and the shelf brackets are made of heat-resistant steel.

8. Cyclone separator according to claim 1, wherein the cyclone separator is lined.

9. Cyclone separator according to claim 2, wherein the cyclone separator is lined.

10. Cyclone separator according to claim 3, wherein the cyclone separator is lined.

11. Cyclone separator according to claim 4, wherein the cyclone separator is lined.

* * * * *